US011976873B2

(12) United States Patent
Butterworth et al.

(10) Patent No.: US 11,976,873 B2
(45) Date of Patent: May 7, 2024

(54) CRYOGENIC COOLER FOR A RADIATION DETECTOR, PARTICULARLY IN A SPACECRAFT

(71) Applicants: L'AIR LIQUIDE, SOCIETE ANONYME POUR L'ETUDE ET L'EXPLOITATION DES PROCEDES GEORGES CLAUDE, Paris (FR); CENTRE NATIONAL D'ÉTUDES SPATIALES, Paris (FR)

(72) Inventors: James Butterworth, Fontaine (FR); Clément Chassaing, Chartres (FR)

(73) Assignee: L'AIR LIQUIDE, SOCIETE ANONYME POUR L'ETUDE ET L'EXPLOITATION DES PROCEDES GEORGES CLAUDE, Paris (FR)

( * ) Notice: Subject to any disclaimer, the term of this patent is extended or adjusted under 35 U.S.C. 154(b) by 263 days.

(21) Appl. No.: 17/622,207

(22) PCT Filed: Jun. 26, 2020

(86) PCT No.: PCT/FR2020/051123

§ 371 (c)(1),
(2) Date: Dec. 22, 2021

(87) PCT Pub. No.: WO2020/260842

PCT Pub. Date: Dec. 30, 2020

(65) Prior Publication Data

US 2022/0412637 A1 Dec. 29, 2022

(30) Foreign Application Priority Data

Jun. 26, 2019 (FR) ..... 19/06948

(51) Int. Cl.
*F25D 19/00* (2006.01)

(52) U.S. Cl.
CPC ..... *F25D 19/006* (2013.01)

(58) Field of Classification Search
CPC ..... F25D 19/006; F25B 9/145; F25B 9/14; F25B 25/005
See application file for complete search history.

(56) References Cited

U.S. PATENT DOCUMENTS 1,329,559 A 2/1920 Tesla
6,637,211 B1 10/2003 Swift et al.
(Continued)

FOREIGN PATENT DOCUMENTS

CN 100557345 C * 11/2009
CN 100557345 C 11/2009
(Continued)

OTHER PUBLICATIONS

International Search Report dated Oct. 12, 2020 re: Application No. PCT/FR2020/051123, pp. 1-2.

*Primary Examiner* — Emmanuel E Duke
(74) *Attorney, Agent, or Firm* — CANTOR COLBURN LLP

(57) ABSTRACT

A cryogenic cooler includes a cold region, a heat-transfer fluid circuit, the cold region being positioned in the circuit, and an application heat exchanger configured to exchange calories with a device to be cooled. The cooler includes at least one passive non-return valve fluidly connected to the cold region, the heat exchanger having at least one first fluid inlet positioned downstream of the non-return valve in the flow direction of the heat-transfer fluid, the heat-transfer fluid circulating from the end of the cold region.

16 Claims, 6 Drawing Sheets

(56) References Cited

U.S. PATENT DOCUMENTS

| | | | |
|---|---|---|---|
| 2013/0067952 | A1 | 3/2013 | Rl et al. |
| 2016/0276082 | A1 | 9/2016 | Ackermann et al. |

FOREIGN PATENT DOCUMENTS

| | | | |
|---|---|---|---|
| JP | 2012255734 | A | 12/2012 |
| WO | 2018065458 | A1 | 4/2018 |

* cited by examiner

[Fig. 1]
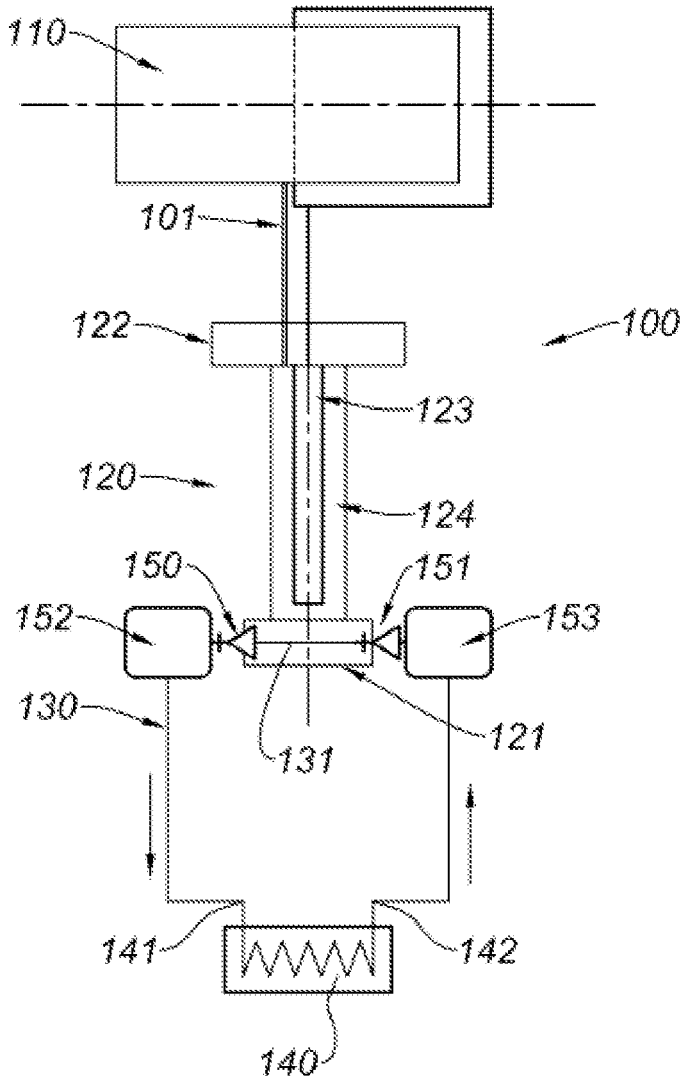

[Fig. 2]
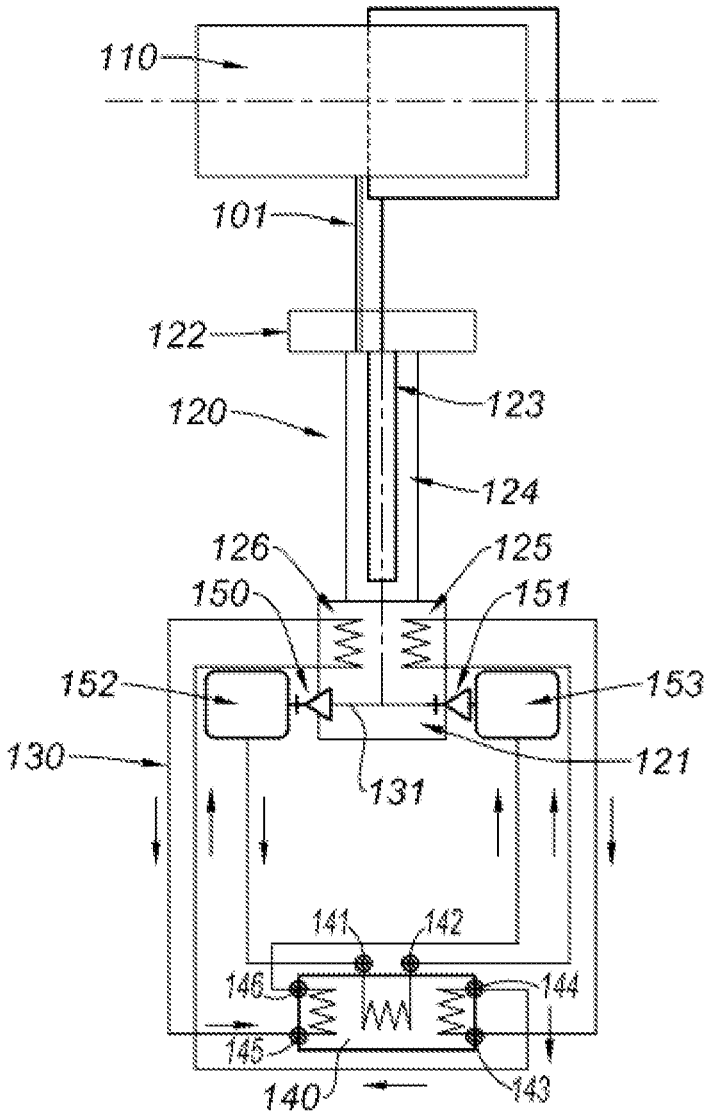

[Fig. 3]
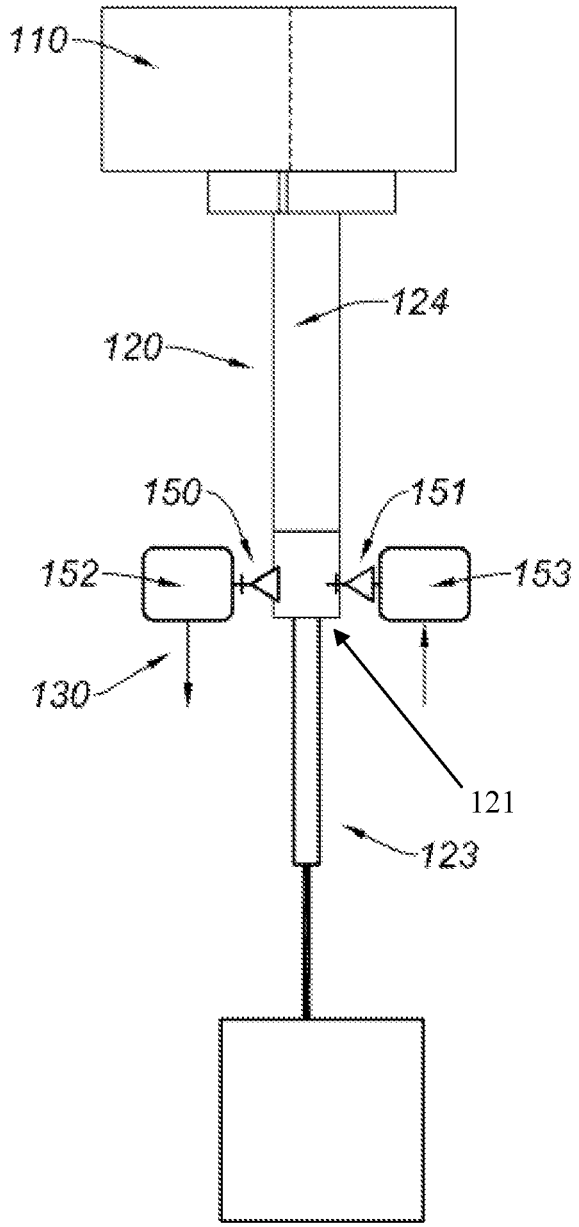

[Fig. 4]
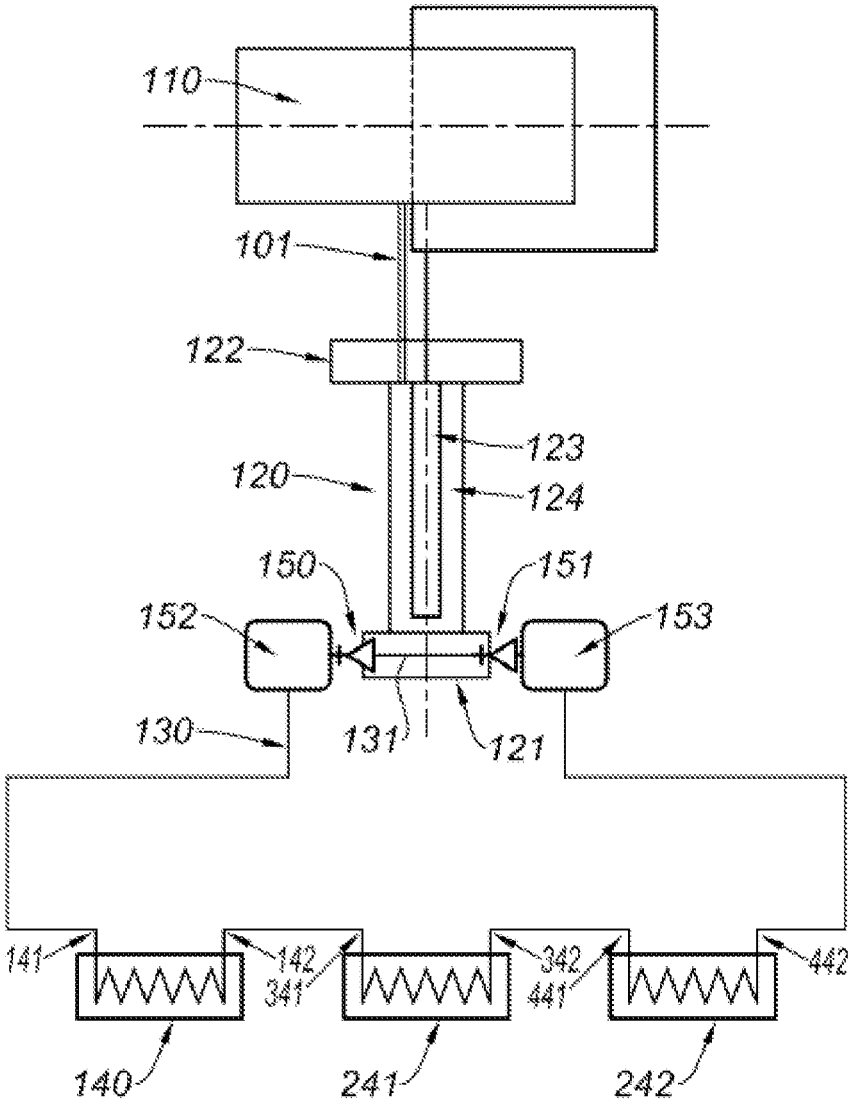

[Fig. 5]
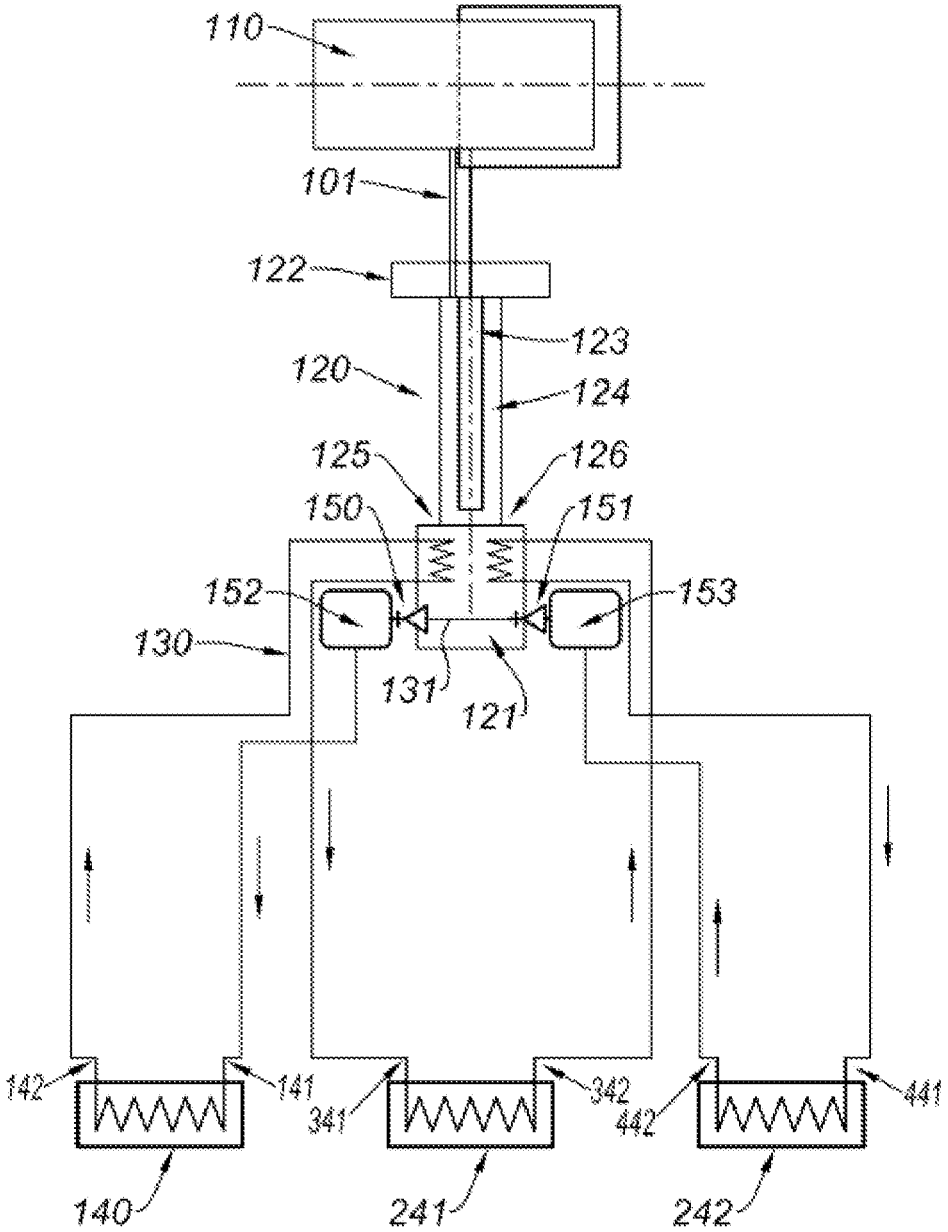

[Fig. 6]
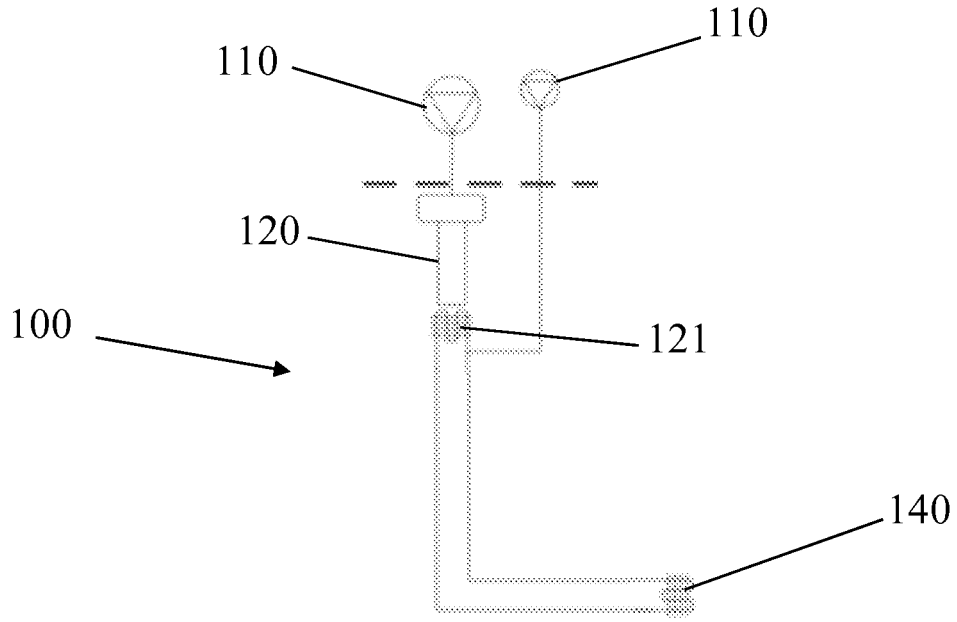
[Fig. 7]
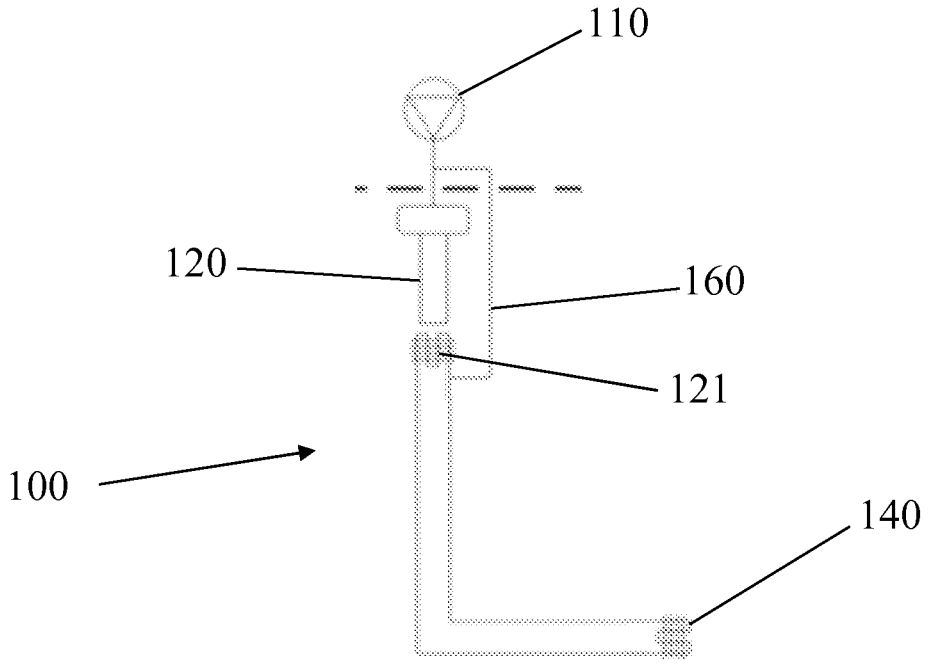

CRYOGENIC COOLER FOR A RADIATION DETECTOR, PARTICULARLY IN A SPACECRAFT

TECHNICAL FIELD

The disclosure concerns the technical field of cryogenic coolers called «cryocoolers». More particularly, the disclosure covers cryocoolers intended to cool radiation detectors or other members requiring cooling in spacecrafts such as for example in satellites or space probes.

BACKGROUND

Stirling or gas-tube type cryogenic coolers are systems filled with a gas, called «working gas», under pressure at a determined value comprising a piston generating a pressure and flow-rate wave in the gas. The pressure and flow-rate wave will be used to generate cold on a cold finger of the system.

Thus, the cryogenic cooler comprises a pressure and flow-rate wave generator, for example a compressor, and a cold finger. The pressure and flow-rate wave generator transmits the pressure and flow-rate wave in the cold finger which allows generating cold down to a determined temperature in the range of −200° C. and even lower, in a cold area of the cold finger for cooling of the member to be cooled, for example a radiation detector of a satellite.

In the space field, it is very difficult to intervene to correct a breakdown. Thus, a safe way to solve this problem is the implementation of two cryogenic coolers one of which functions while the other functions only in case of failure of the first one. The major drawback of this approach is that even though the second cooler does not function as long as the first one is functioning, there is still some thermal conduction in its cold finger because in order to ensure the switch between the coolers in case of deficiency of either one, they cold areas shall be thermally connected. Yet, all what pertains to thermal conduction in the cold finger of the second cooler through the cold finger of the first cooler which is active. One solution may consist in decoupling the cold area of the second cooler to avoid heat supplies.

To decouple the cold area of the second cooler, a known solution consists in positioning each cold area of each cooler in a thermal closed circuit called thermal loop in which a heat-transfer fluid is made to circulate between the cold area and the member to be cooled. In this configuration, it is possible to selectively activate only one thermal loop so that the thermal loop in which the cold area of the second cooler is positioned remains inactive and no heat supply occurs. Each of these thermal loops may include a mechanical circulator type element which is intended to make the heat-transfer fluid circulate in the loop. Thus, by activating one of these circulators, the thermal loop that contains it is activated.

Another way for making the heat-transfer fluid circulate consists in connecting the loop to the outlet of the pressure and flow-rate wave generator by a system of check valves so as to rectify the alternating pressure and flow-rate wave in a continuous flow. In this configuration, the working gas of the cooler is of the same kind as the heat-transfer fluid in the loop, that is to say the working gas and the heat-transfer fluid are the same. The working gas fluidly communicates with the heat-transfer fluid. In the event where a pressure and flow-rate wave generator stops functioning, the flow of the heat-transfer fluid in the loop stops and the associated cold area is thermally isolated. In this configuration, the extraction, called «hot-extraction», of the heat-transfer fluid is done when the heat-transfer fluid is hot from a transfer line connecting the pressure and flow-rate wave generator and the cold area, then this heat-transfer fluid is conveyed in a «counter-current» heat-exchanger, then passes into a heat-exchanger thermally connected to the cold area. Once the heat-transfer fluid is cooled, the latter passes in an application exchanger and afterwards rises in the counter-current exchanger to cool the working gas which descends again from the transfer line towards the cold area. This configuration allows avoiding sending very hot gas directly in the cold portion but requires the use of counter-current exchanger, which might pose the following drawbacks: high pressure drops in the counter-current heat-exchanger, high losses by radiation due to the heat-exchanger and the complex fluid circuit connecting the cold area. CN100557345C describes a system that operates according to this principle but whose purpose is the optimization of the heat transfer towards the cold area and not the thermal isolation of the redundant cryogenic cooler.

U.S. Pat. No. 6,637,211 describes an oscillatory-wave engine or refrigerator. A heat-transfer gas loop fluidly communicates with the working gas in the body of the engine or refrigerator. At least one fluidic diode in the heat-transfer gas loop produces a continuous flow component superimposed on the oscillating flow originating from the working gas. In general, the dimensions of the gas loop and the location of the fluidic diodes are selected so as to make the gas loop resonant. The extraction from the working gas towards the heat-transfer gas loop may be done proximate to the hot exchanger (hot extraction) or proximate to the cold exchanger (cold extraction) of the engine or refrigerator. A secondary heat-transfer fluid is in thermal contact with an external portion of the gas loop. According to U.S. Pat. No. 6,637,211, the resonant loops seem to be suited only to very-high-frequency pulse-tubes or to very long loops. Furthermore, the gas loop exchanges with a secondary heat-transfer fluid for the transfer of heat towards or from the gas loop. The gas loop, as described, is designed so as to increase the heat-exchange capacity in high-power engines or refrigerators and does not represent a heat-insulation means of a redundant cold finger.

SUMMARY

The disclosure aims at overcoming all or part of the aforementioned drawbacks and in particular at enabling an extraction of the heat-transfer fluid that is more advantageous than that described hereinbefore without the use of a counter-current exchanger and without the geometric and frequency constraints imposed by a resonant system.

To this end, the disclosure is provides a cryogenic cooler comprising:

- at least one pressure and flow-rate wave generator,
- at least one cold finger comprising a cold area, the pressure and flow-rate wave generator being fluidly connected to the cold finger,
- at least one heat-transfer fluid circuit,
- at least one application heat-exchanger configured to exchange calories with at least one device to be cooled, characterized in that the cooler comprises at least:

- a first check valve and a second check valve positioned in the circuit, at least one check valve amongst the first and second check valves being a passive check valve, the first check valve and the second check valve being fluidly connected to the cold finger, the at least one application heat-exchanger comprising at least one first fluid inlet positioned downstream of the first check valve in the direction of circulation of the heat-transfer fluid, and at least one first fluid outlet positioned upstream of the second check valve in the direction of circulation of the heat-transfer fluid.

Advantageously, thanks to this configuration according to the disclosure, a portion of the pressure and flow-rate wave generated by the pressure and flow-rate wave generator of the cooler is extracted at the level of the cold area, which allows for a cold extraction that is more advantageous than a hot extraction. Moreover, this configuration allows combining both a thermal link and a thermal disconnection. Furthermore, the configuration can also operate with a lower temperature in the range of 15K for example, which is hardly possible in the configurations of the prior art. Finally, this configuration allows for an easy distribution of the cold power on the application heat-exchanger, of the device to be cooled.

Advantageously, the heat-exchange fluid directly exchanges with the application on the contrary with the aforementioned document U.S. Pat. No. 6,637,211.

Furthermore, thanks to the disclosure, a heat-transfer fluid circuit is used to thermally disconnect the cold finger from the application and thus limit the thermal load originating from a redundant cooler.

According to a feature of the disclosure, the first check valve and the second check valve are passive check valves.

In the present disclosure, by «passive check valve», it should be understood a check valve whose geometry is set and passive and configured to promote the circulation of a fluid in a direction without any movable element.

According to a feature of the disclosure, at least one of the two, preferably each check valve, comprises one or several Tesla diode(s) in series.

The advantage of Tesla diodes, as described in U.S. Pat. No. 1,329,559, is that they have asymmetrical impedances and therefore the fluid flows passing through are asymmetrical which allows making the fluid, preferably the gas, pass in a direction other than the reverse direction. Furthermore, the use of a Tesla diode is more reliable in particular in its application in space crafts and machines since, unlike mechanical valves, these do not pose problems relating to reliability or deficiency due to wearing of the parts.

According to a feature of the disclosure, the first check valve is a check valve configured to enable the passage of the heat-transfer fluid during positive excursions of the pressure and flow-rate wave in the cold area.

The pressure and flow-rate wave generator creates pressure oscillations at a determined frequency in the heat-transfer fluid around an average pressure value. Hence, there are successive positive and negative pressure excursions relative to this average pressure.

According to a feature of the disclosure, the second check valve is a check valve configured to enable the passage of the heat-transfer fluid during negative excursions of the pressure and flow-rate wave in the cold area.

According to a feature of the disclosure, the application heat-exchanger comprises a plurality of inlets associated to a plurality of fluid outlets.

According to a feature of the disclosure, the application heat-exchanger comprises at least one second fluid inlet, a second fluid outlet, a third fluid inlet and a third fluid outlet.

According to a feature of the disclosure, the cold area comprises at least one first heat-exchange area in which the heat-transfer fluid circulates.

According to a feature of the disclosure, the cold area comprises a plurality of heat-exchange areas.

Advantageously, the cold area comprises a cold area heat-exchanger integrating the at least one first heat-exchange area of the cold area.

According to a feature of the disclosure, the cold area comprises a plurality of cold area heat-exchangers.

According to a feature of the disclosure, the outlet of the first check valve is fluidly connected to the first inlet of the application heat-exchanger.

According to a feature of the disclosure, the first fluid outlet of the application heat-exchanger is fluidly connected to the first heat-exchange area of the cold area, the first fluid outlet being positioned upstream of the first heat-exchange area of the cold area in the direction of circulation of the heat-transfer fluid.

According to a feature of the disclosure, the second fluid inlet of the application heat-exchanger is fluidly connected to the first heat-exchange area of the cold area, the second fluid inlet being positioned downstream of the first heat-exchange area of the cold area in the direction of circulation of the heat-transfer fluid.

According to a feature of the disclosure, the second fluid outlet of the application heat-exchanger is fluidly connected to the second heat-exchange area of the cold area, the second fluid outlet being positioned upstream of the second heat-exchange area of the cold area in the direction of circulation of the heat-transfer fluid.

According to a feature of the disclosure, the third fluid inlet of the application heat-exchanger is fluidly connected to the second heat-exchange area of the cold area, the third fluid inlet being positioned downstream of the second heat-exchange area of the cold area in the direction of circulation of the heat-transfer fluid.

According to a feature of the disclosure, the third fluid outlet of the application heat-exchanger is fluidly connected to the second check valve, the third fluid outlet of the exchanger being positioned upstream of the second check valve in the direction of circulation of the heat-transfer fluid.

According to a feature of the disclosure, the first check valve and the second check valve fluidly connected to the cold area by a direct line According to a feature of the disclosure, the cooler comprises a plurality of application heat-exchangers, for example three, each comprising at least one heat-transfer fluid inlet and a heat-transfer fluid outlet forming a heat-exchange area.

The advantage of enabling the circulation of the heat-transfer fluid in the heat-exchange areas of the cold area and in the application heat-exchanger, is that the cooling capacity will be optimized in comparison with one single passage in the application heat-exchanger and in the cold area. Thus, with the same flow-rate of the heat-transfer fluid, the heat transfer efficiency is multiplied by three.

In other terms, the cold area may include more or less heat-exchange areas (number of exchange areas greater than or equal to 0) in order to optimize the heat-exchange. In general, the application heat-exchanger will include one more heat-exchange area than the cold area.

According to a feature of the disclosure, the cooler comprises at least one first buffer tank positioned downstream of the first check valve in the direction of circulation of the heat-transfer fluid, and configured to smooth the pressure and flow-rate wave which has been rectified by the first check valve so as to make a continuous flow of the heat-transfer fluid pass in the circuit.

According to a feature of the disclosure, the cooler comprises at least one second buffer tank positioned upstream of the second check vale in the direction of circulation of the heat-transfer fluid, and configured to smooth the pressure and flow-rate wave which has been rectified by the second check valve before being re-injected into the cold area.

According to a feature of the disclosure, the pressure of the heat-exchange fluid in the first tank is higher than the pressure of the heat-transfer fluid in the second buffer tank.

According to a feature of the disclosure, the thermal power transferred between the cold area and the application heat-exchanger is equal to the mass flow-rate of the heat-transfer fluid flow multiplied by the specific heat of the heat-transfer fluid multiplied by the difference in temperature between the cold area and the heat-exchanger. Advantageously, when the pressure in the cold area increases, part of the heat-transfer fluid is injected into the first buffer tank. When the pressure in the cold area decreases, the heat-transfer fluid is sucked in from the second buffer tank which creates a pressure difference between the two buffer tanks and this pressure difference will make the heat-transfer fluid circulate in the circuit.

According to a feature of the disclosure, the heat-transfer fluid is a gas and preferably Helium.

According to a feature of the disclosure, at least one of the two buffer tanks is constituted by a portion of the heat-transfer fluid circuit.

Indeed, the buffer tank may be constituted by locally increasing a portion of the heat-transfer fluid circuit.

According to a feature of the disclosure, the cryogenic cooler is a pulse-tube type or Stirling type cooler.

In the present disclosure, by «Stirling engine or cooler», it should be understood an external energy engine or cooler. The main fluid is a gas subjected to a cycle comprising four phases: constant-volume heating, isothermal expansion, constant-volume cooling, isothermal compression.

According to a feature of the disclosure, the thermal link between the cold area and the application heat-exchanger may have a length larger than 0.5 meters and preferably comprised between 1 and 3 meters.

According to a feature of the disclosure, the cooler comprises a plurality of application heat-exchangers configured to exchange calories with a plurality of devices to be cooled.

According to one embodiment, the cold finger is in fluidic communication with said heat-transfer fluid circuit.

According to another embodiment, the cold finger is not in fluidic communication with said heat-transfer fluid circuit and the cooler includes a small pressure and flow-rate wave generator connected to the cold end of the heat-transfer fluid circuit.

According to another embodiment, the cold finger is not in fluidic communication with said heat-transfer fluid circuit and the cooler includes a T-type direct branch fluidly connecting the pressure and flow-rate wave generator and the cold finger.

The disclosure also covers a spatial set comprising at least one radiation detector and a cryogenic cooler according to the disclosure, the application heat-exchanger being configured to cool the radiation detector.

The radiation detector may be a detector of infrared, X-ray, gamma-ray, hyper frequency radiation, or any other type of electromagnetic or corpuscular radiation.

BRIEF DESCRIPTION OF THE DRAWINGS

The disclosure will be better understood, thanks to the description hereinafter, which relates to embodiments according to the present disclosure, provided as non-limiting examples and explained with reference to the appended schematic figures. The appended schematic figures are listed hereinbelow:

FIG. 1 is a schematic view of the cryogenic cooler according to the disclosure according to a first embodiment;

FIG. 2 is a schematic view of the cryogenic cooler according to the disclosure according to a second embodiment;

FIG. 3 is a schematic view of the cryogenic cooler according to the disclosure according to a third embodiment;

FIG. 4 is a schematic view of the cryogenic cooler according to the disclosure according to a fourth embodiment;

FIG. 5 is a schematic view of the cryogenic cooler according to the disclosure according to a fifth embodiment;

FIG. 6 is a schematic view of the cryogenic cooler according to the disclosure according to a sixth embodiment; and FIG. 7 is a schematic view of the cryogenic cooler according to the disclosure according to a seventh embodiment.

DETAILED DESCRIPTION OF THE DRAWINGS

The cryogenic cooler 100 according to the disclosure and as illustrated in FIGS. 1 to 5, comprises, regardless of the embodiment, a pressure and flow-rate wave generator 110, a cold finger 120 comprising a cold area 121, a heat-transfer fluid circuit 130, at least one application heat-exchanger 140, 241, 242, configured to exchange calories with a device to be cooled (not represented). Advantageously, the device to be cooled may consist of an electromagnetic or corpuscular radiation detector configured to be integrated to a satellite or to a space probe.

Regardless of the embodiment, the cryogenic cooler 100 comprises a first check valve 150 and a second check valve 151. The first check valve 150 and the second check valve 151 are positioned on either side of the cold area 121 in the circuit 130.

In the illustrated examples and regardless of the embodiment of the circuit of the cooler 100, the first and second check valves are passive check valves, for example Tesla diodes. The first check valve 150 and the second check valve 151 are fluidly connected to the cold area 121 by a direct line 131.

In the embodiments represented in FIGS. 1, 2, 4 and 5, the cold finger 120 comprises a distal cold area 121 of the pressure wave generator 110 and a proximal hot end 122 of the pressure wave generator 110. In the body of the cold finger 120, is arranged a pulse tube 123 around which a regenerator 124 is positioned.

Furthermore, a transfer line 101 fluidly connects the pressure and flow-rate wave generator 110 to the cold area 120.

In the embodiment represented in FIG. 3, the cold area 121 is positioned substantially between the regenerator 124 and the pulse tube 123. Hence, the cold area is central.

According to the second and fifth embodiments, the cold area 121 comprises a first heat-exchange area 125 and a second heat-exchange area 126 in each of which the heat-transfer fluid circulates.

Advantageously, the cold area 121 comprises a cold area heat-exchange integrating the first 125 and second 126 heat-exchange areas of the cold area 121.

In FIG. 1, there is represented the cryogenic cooler 100 according to the disclosure comprising a circuit 130 according to a first embodiment. In this first embodiment, the heat-transfer fluid circulates as follows. Starting from a direct line 131 connecting the cold area 121 with the first and second check valves 150, 151, the fluid circulates towards the first check valve 150 which comprises a channel directed in a preferred direction of circulation so that the fluid preferably circulates in this direction. The fluid reaches a first buffer tank 152 configured to smooth the pressure of the fluid within the circuit 130. The heat-transfer fluid is directed towards a first fluid inlet 141 of the application heat-exchanger 140 configured to exchange with the device to be cooled. The fluid comes out of the exchanger 140 through a first outlet 142 and is directed towards a second buffer tank 153 configured to smooth again the pressure of the fluid coming out of the exchanger. Afterwards, the fluid passes through the second check valve 151, which is configured in the same direction of circulation as the first check valve 150.

In this configuration, the thermal conductance in operation is substantially 0.12 W/K.

In FIG. 2, there is represented the cryogenic cooler 100 according to the disclosure comprising a circuit 130 according to a second embodiment. In this second embodiment, the heat-transfer fluid circulates as follows. Starting from the direct line 131 connecting the cold area 121 with the first and second check valves 150, 151, the fluid circulates towards the first check valve 150 which comprises a channel directed in a preferred direction of circulation so that the fluid preferably circulates in this direction. The fluid reaches a first buffer tank 152 configured to smooth the pressure of the fluid within the circuit 130. The heat-transfer fluid is directed towards the first fluid inlet 141 of the heat-exchanger 140 configured to exchange with the device to be cooled. The fluid comes out of the exchanger 140 through a first outlet 142 and is directed towards a first heat-exchange area 125 of the cold area 121. Once the first exchange area 125 is crossed, the fluid is directed again towards the exchanger 140 and comes in through the second inlet 143 and comes out through the second outlet 144 and is directed towards a second heat-exchange area 126 of the cold area 121. Once the second exchange area 126 is crossed, the fluid is directed again towards the exchanger 140 and comes in through the third inlet 142 and comes out through the third outlet 146 and is directed towards the second buffer tank 153 configured to smooth the pressure of the fluid coming out of the exchanger 140. Afterwards, the fluid passes through the second check valve 151, which is configured in the same direction of circulation as the first check valve 150.

In this configuration, the heat-transfer fluid passes three times in the heat-exchanger 140, the thermal conductance in operation is thus increased up to 0.35 W/K, with a start/stop thermal conductance ratio of the cooler of less than 1750.

Alternatively and in order to improve the performance of the cooler, the heat-transfer fluid could pass six times or more in the heat-exchanger 140. The thermal conductance evolving linearly, it is possible to expect a thermal conductance in operation in the range of 0.72 W/K with a start/stop thermal conductance ratio of the cooler of 1800.

In FIG. 3, there is represented the cryogenic cooler 100 according to the disclosure comprising a circuit 130 according to a third embodiment. The third embodiment differs from the embodiments illustrated in FIGS. 1,2, 4 and 5 in that it does not comprise a direct line 131 between the first and second check valves 150, 151. The heat-transfer fluid circulates in the entirety of the cold area 121.

In the fourth embodiment, the heat-transfer fluid circulates from the direct line 131 towards the first check valve 150. The fluid reaches a first buffer tank 152 configured to smooth the pressure of the fluid within the circuit 130. Then, the heat-transfer fluid is directed towards a first fluid inlet 141 of the application heat-exchanger 140 configured to exchange with a first device to be cooled. The fluid comes out of the exchanger 140 through a first outlet 142. The heat-transfer fluid is then directed towards a first fluid inlet 341 of a second application heat-exchanger 241 configured to exchange with a second device to be cooled. The fluid comes out of the exchanger 241 through a first outlet 342. The heat-transfer fluid is then directed towards a first fluid inlet 441 of a third application heat-exchanger 242 configured to exchange with a third device to be cooled. The fluid comes out of the exchanger 242 through a first outlet 442. Finally, the heat-transfer fluid is directed towards a second buffer tank 153 configured to smooth again the pressure of the fluid coming out of the exchanger. Afterwards, the fluid passes through the second check valve 151, which is configured in the same direction of circulation as the first check valve 150.

In the fifth embodiment, the heat-transfer fluid circulates from the direct line 131 towards the first check valve 150. The fluid reaches a first buffer tank 152 configured to smooth the pressure of the fluid within the circuit 130. Then, the heat-transfer fluid is directed towards a first fluid inlet 141 of the application heat-exchanger 140 configured to exchange with a first device to be cooled. The fluid comes out of the exchanger 140 through a first outlet 142 and is directed towards a first heat-exchange area 125 of the cold area 121. Once the first exchange area 125 is crossed, the fluid is then directed towards a first fluid inlet 341 of a second application heat-exchanger 241 configured to exchange with a second device to be cooled. The fluid comes out of the exchanger 241 through a first outlet 342 and is directed towards a second heat-exchange area 126 of the cold area 121. Once the second exchange area 126 is crossed, the fluid is then directed towards a first fluid inlet 441 of a third application heat-exchanger 242 configured to exchange with a third device to be cooled. The fluid comes out of the exchanger 242 through a first outlet 442. Finally, the heat-transfer fluid is directed towards a second buffer tank 153 configured to smooth again the pressure of the fluid coming out of the exchanger. Afterwards, the fluid passes through the second check valve 151, which is configured in the same direction of circulation as the first check valve 150.

In the sixth embodiment, schematically represented in FIG. 6, the cryogenic cooler 100 according to the disclosure differs from the previously-described one in that the cold finger 120 is not in fluidic communication with said heat-transfer fluid circuit 130 and in that it includes a small pressure and flow-rate wave generator 110 fluidly connected to the cold end of the heat-transfer fluid circuit 130.

In the seventh embodiment, schematically represented in FIG. 7, the cryogenic cooler 100 according to the disclosure differs from the previously-described one in that the cold finger 120 is not in fluidic communication with said heat-transfer fluid circuit 130 and in that it includes a T-type direct branch 160 fluidly connecting the pressure and flow-rate wave generator 110 and the cold finger 120. A heating switch is activated as soon as the cooler is turned on.

It should be noted that this integration is that one which has the least impact on the cooler. Of course, the disclosure is not limited to the embodiments described and represented in the appended figures. Modifications are still possible, in particular with regards to the constitution of the various elements or by substitution with technical equivalents, yet without departing from the scope of the disclosure.

The invention claimed is:

1. A cryogenic cooler comprising:

at least one pressure and flow-rate wave generator, at least one cold finger comprising a cold area, the pressure and flow-rate wave generator being fluidly connected to the cold finger, at least one heat-transfer fluid circuit, at least one application heat-exchanger configured to exchange calories with at least one device to be cooled, wherein the cooler further comprises at least:

a first check valve and a second check valve positioned in the circuit, at least one check valve amongst the first and second check valves being a passive check valve, the first check valve and the second check valve being fluidly connected to the cold finger, the at least one application heat-exchanger comprising at least one first fluid inlet positioned downstream of the first check valve in the direction of circulation of the heat-transfer fluid, and at least one first fluid outlet positioned upstream of the second check valve in the direction of circulation of the heat-transfer fluid.

2. The cryogenic cooler according to claim 1, wherein at least one of the check valves comprises one or several Tesla diode(s) in series.

3. The cryogenic cooler according to claim 1, wherein the application heat-exchanger comprises a plurality of inlets associated to a plurality of fluid outlets.

4. The cryogenic cooler according to claim 3, wherein the cold area comprises at least one first heat-exchange area in which the heat-transfer fluid circulates.

5. The cryogenic cooler according to claim 4, wherein the first fluid outlet of the application heat-exchanger is fluidly connected to the first heat-exchange area of the cold area, the first fluid outlet being positioned upstream of the first heat-exchange area of the cold area in the direction of circulation of the heat-transfer fluid.

6. The cryogenic cooler according to claim 5, wherein the second fluid inlet of the application heat-exchanger is fluidly connected to the first heat-exchange area of the cold area, the second fluid inlet being positioned downstream of the first heat-exchange area of the end of the cold area in the direction of circulation of the heat-transfer fluid.

7. The cryogenic cooler according to claim 1, comprising a plurality of application heat-exchangers each comprising at least one heat-transfer fluid inlet and a heat-transfer fluid outlet forming a heat-exchange area.

8. The cryogenic cooler according to claim 1, comprising at least one first buffer tank positioned downstream of the first check valve in the direction of circulation of the heat-transfer fluid, and configured to smooth the pressure and flow-rate wave extracted at the level of the cold area.

9. The cooler according to claim 8, wherein at least one of the two buffer tanks is constituted by a portion of the heat-transfer fluid circuit.

10. The cryogenic cooler according to claim 1, comprising at least one second buffer tank positioned upstream of the second check vale in the direction of circulation of the heat-transfer fluid, and configured to smooth the pressure and flow-rate wave arriving at the level of the cold area.

11. The cooler according to claim 1, wherein said cooler is a pulse-tube or a Stirling cooler.

12. The cooler according to claim 1, wherein the cold finger is in fluidic communication with said heat-transfer fluid circuit.

13. The cooler according to claim 1, wherein the cold finger is not in fluidic communication with said heat-transfer fluid circuit and in that said cooler includes a small pressure and flow-rate wave generator connected to the cold end of the heat-transfer fluid circuit.

14. The cooler according to claim 1, wherein the cold finger is not in fluidic communication with said heat-transfer fluid circuit and in that said cooler includes a T-type direct branch fluidly connecting the pressure and flow-rate wave generator and the cold finger.

15. The cooler according to claim 1, comprising a plurality of application heat-exchangers configured to exchange calories with a plurality of devices to be cooled.

16. A spatial set comprising at least one radiation detector and a cryogenic cooler according to claim 1, the application heat-exchanger of the cooler being configured to cool the radiation detector.

* * * * *